United States Patent [19]

Kobres, Jr.

[11] 4,060,247

[45] Nov. 29, 1977

[54] GEOMETRIC PUZZLE

[76] Inventor: Robert E. Kobres, Jr., Rte. 1, Nicholson, Ga. 30565

[21] Appl. No.: 681,519

[22] Filed: June 28, 1976

[51] Int. Cl.[2] ..... A63F 9/12

[52] U.S. Cl. ..... 273/157 R; 35/34

[58] Field of Search ..... 273/157 R; 35/18 A, 35/34

[56] References Cited

U.S. PATENT DOCUMENTS

| | | | |
|---|---|---|---|
| 3,837,652 | 9/1972 | Kuwagaki et al. | 273/157 R |
| 3,945,645 | 3/1976 | Roberts | 273/157 R |

OTHER PUBLICATIONS

Martin Gardner's New Mathematical Diversions from Scientific American, published by Simon & Schuster, New York 1966, pp. 82–90.

*Primary Examiner*—Anton O. Oechsle

*Attorney, Agent, or Firm*—Frank A. Peacock

[57] ABSTRACT

A five-piece geometric puzzle is disclosed. This geometric puzzle uses three basic shapes which can be arranged either as a two dimensional rhomboid or a three dimensional tetrahedron. The puzzle set is constituted by two pieces each comprising six connected balls in a planar rhomboid array, two pieces each comprising two connected balls, and one piece comprising four connected balls in planar linear array. Multiple sets of the pieces may be provided.

2 Claims, 10 Drawing Figures

GEOMETRIC PUZZLE

DISCLOSURE

Figure 1:
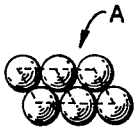
FIG. 1 shows a six ball configuration puzzle piece.

This geometric puzzle consists of twenty balls of equal diameters attached in the following manner:

Two pieces $A_1$, $A_2$ in a six ball configuration (FIG. 1)

Figure 2:
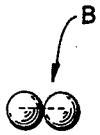
FIG. 2 shows a two ball configuration puzzle piece.

Two pieces $B_1$, $B_2$ in a two ball configuration (FIG. 2)

Figure 3:
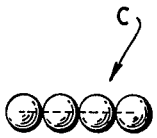
FIG. 3 shows a four ball configuration piece.

One piece C in a four ball configuration (FIG. 3)

Figure 4:
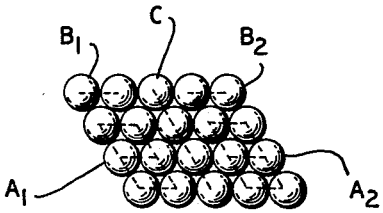
FIG. 4 shows a top plan view of the pieces assembled to form a two dimensional rhomboid.
Figure 5:
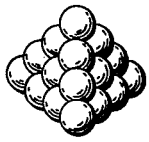
FIG. 5 shows a perspective view of the pieces assembled to form a tetrahedron.
Figure 6A:
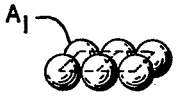
FIGS. 6A–6E show the step-by-step assembly of the tetrahedron.
Figure 6B:
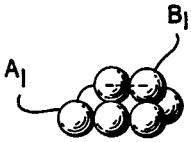
Figure 6C:
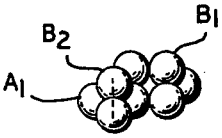
Figure 6D:
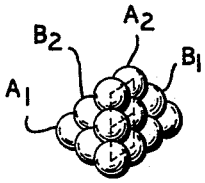
Figure 6E:
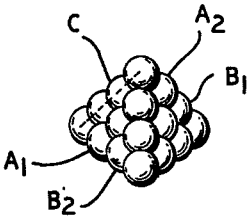

The purpose of this geometric puzzle is to demonstrate the closest relationship of points in both the two and three dimensional form. In other words, the five pieces of this geometric puzzle can go together either as a rhomboid (FIG. 4), or as a tetrahedron (FIG. 5 and 6).

In addition, I have discovered that:

1. The three basic configurations (FIGS. 1, 2, and 3) may be used as building blocks to construct other geometric forms, such as a square base pyramid or a cuboctrahedron.

2. This geometric puzzle repeats itself. Six sets (30 pieces) will combine to produce a tetrahedron with eight ball edges, 11 sets — 10 ball edges, 28 sets — 14 ball edges, and so on.

Some uses of this invention are:

1. To demonstrate the closest relationship of points in both a two and three coordinate system with a degree of entertainment.
2. To enhance ones spatial reasoning by way of building various forms with unusual shapes.
3. A barometer of spatial reasoning by comparing the time required to solve the puzzle with an average time.
4. To entertain. It is enjoyable to see how many different shapes and forms you can come up with. Also, I have devised a card game that utilizes the puzzles.

I claim:

1. A geometric puzzle comprising two pieces having six connected balls in a planar array as shown in FIG. 1, two pieces having two connected balls as shown in FIG. 2, and one piece having four connected balls in planar array as shown in FIG. 3, said pieces being assemblable into either a two dimensional rhomboid or a three dimensional tetrahedron.

2. A geometric puzzle as defined in claim 1 further comprising multiple sets of said pieces which may be assembled into larger rhomboids and tetrahedrons.

* * * * *